United States Patent [19]

Fisher

[11] 4,117,598

[45] Oct. 3, 1978

[54] DRAWING INSTRUMENT OR APPARATUS

[76] Inventor: Denys Fisher, Kirkconnel Lea, Glencaple, Dumfries, Scotland

[21] Appl. No.: 842,657

[22] Filed: Oct. 17, 1977

[51] Int. Cl.[2] ..... B43L 11/00; B43L 9/00

[52] U.S. Cl. ..... 33/27 L

[58] Field of Search ..... 33/27 L, 27 K, 23 C

[56] References Cited

U.S. PATENT DOCUMENTS

| | | | |
|---|---|---|---|
| 3,535,791 | 10/1970 | Oppenheim | 33/27 L |
| 3,857,187 | 12/1974 | Jensen et al. | 33/27 L |

FOREIGN PATENT DOCUMENTS

| | | | |
|---|---|---|---|
| 1,222,873 | 1/1960 | France | 33/27 L |

*Primary Examiner*—Harry N. Haroian

*Attorney, Agent, or Firm*—L. MeRoy Lillehaugen

[57] ABSTRACT

A design drawing instrument for creating numerous decorative patterns and designs. The instrument includes a member having a circular groove therein, a guide or design plate having at least one guide track thereon, and a cursor having means for slidably engaging the circular groove and a holder for at least one marking instrument. By moving the cursor relative to the design plate in a prescribed manner, a pattern or design can be produced on a drawing surface.

24 Claims, 15 Drawing Figures

70
70
56
58
60
62
64
66
68
6
74

10
2A
16
2
1
8
14
18
4
12
24
20
22

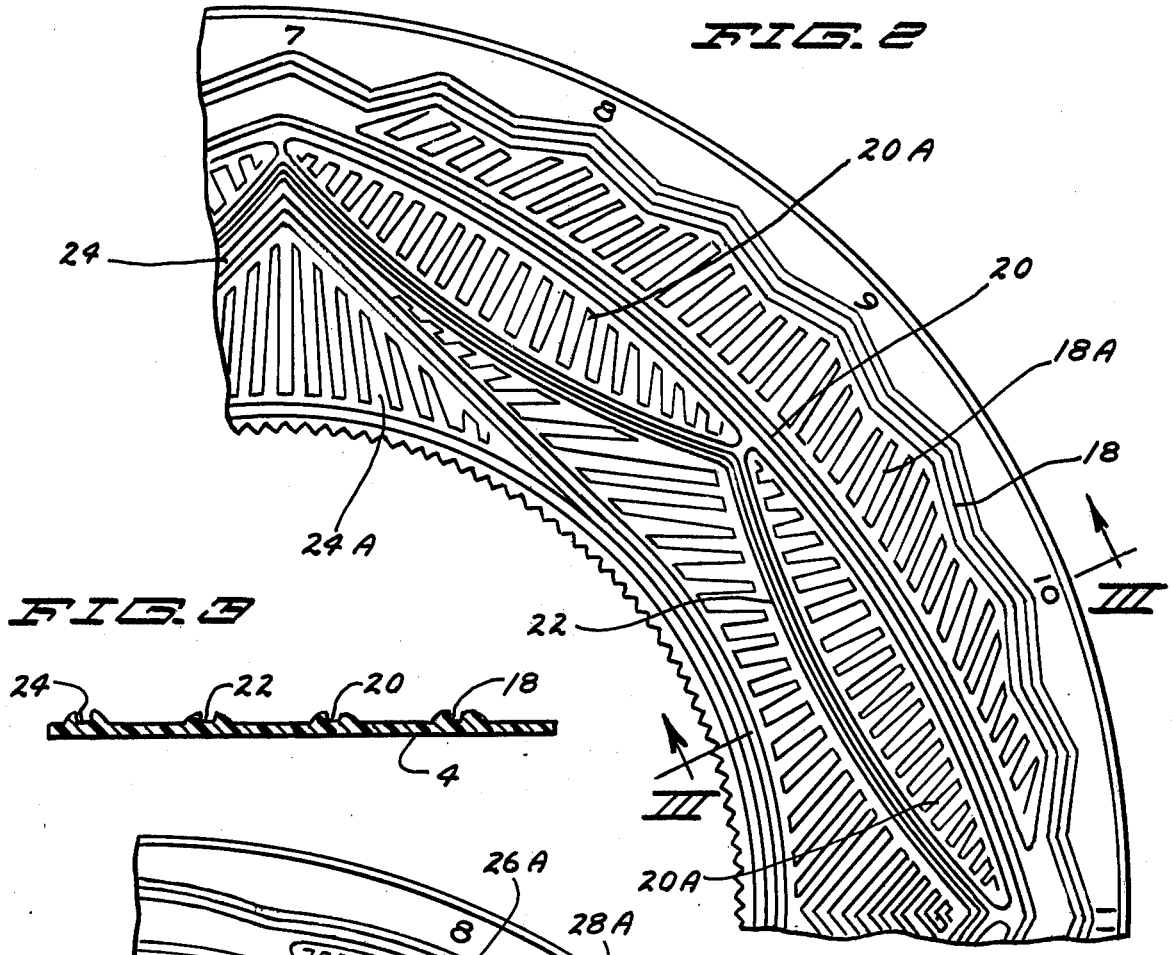
FIG. 2
FIG. 3
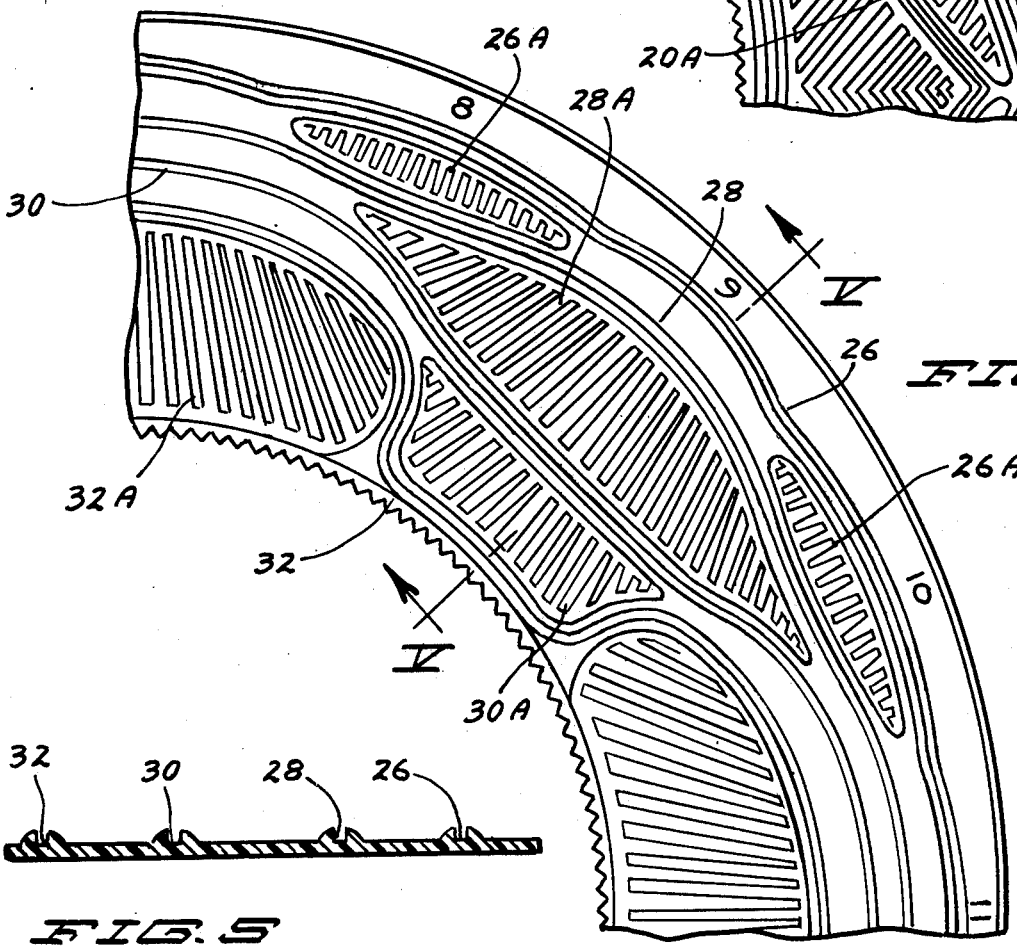
FIG. 4
FIG. 5

DRAWING INSTRUMENT OR APPARATUS

The present invention relates to drawing instruments or apparatus, and more specifically, to drawing instruments intended primarily, but not exclusively, for use by children in the creation of decorative patterns and designs of a varying nature.

The invention enables the user to produce novel and interesting abstract designs or alternatively non-abstract drawings by the use of a mechanism with only one moving part which is controlled during its movement by spigots and guide tracks or grooves. The shape drawn, when the movable member is moved, is determined by the geometrical interaction of the shape of the guide tracks or grooves and the location of the spigots and the drawing member (pen or the like) relative to one another and the guide tracks or grooves. By making a series of drawings, altering the location of the pen or the like and/or a stylus, it becomes apparent how the same guide tracks can produce shapes which vary from one form to another.

According to the present invention, there is provided a drawing instrument or apparatus comprising a primary member and a secondary member or cursor, which is movable relative to said primary member, by the engagement of two spigots with one or more guide paths, one of said members having one or more holes or apertures through which may project the tip or point of a writing, drawing, or scribing instrument such that a design or drawing is produced on the other of said members.

Generally, the mechanism includes two separate members, a primary member and a secondary member, one member being movable relative to the other. The movement of one member relative to the other is controllable by the nature of the contact between the members. The secondary movable member is placed upon the primary stationary member and in addition to sliding contact of the underside of the secondary member on the upper side of the primary member, conrol contact takes place at two points, where, in each case, a spigot of one member is positioned in a guide track, groove or panel of the other member.

The primary member may carry two or more guide tracks or grooves, or one spigot and one or more guide tracks or grooves, or two spigots only, in which case the secondary member would have two spigots, one spigot and one or more guide tracks or grooves, or two or more guide tracks or grooves only.

The surface to be drawn upon may form part of the primary member or it may form part of the secondary member. Accordingly, the pen or pens will be holdable in the secondary member or the primary member.

Both spigots may take the form of attached pegs, or stylii inserted in holes or slots or a combination thereof, or one spigot may in fact be the circular exterior of one member or a circular sleeve protruding from it. In both such cases the other spigot would be in the form of an attached peg or stylus inserted in one hole of a series of holes. Furthermore, one spigot may take the form of a pin passing right through a guide track or groove which would therefore become a guide slot, the pin being positioned in a hole in the other member. Alternatively, the spigot may take the form of a visual point or marker which is controlled by eye to follow a guide line, groove or slit on the other member.

The guide track, groove, panel, slot or channel may be of any shape, either continuous or non-continuous, its cross-section being designed to receive and guide the relevant spigot. In one case, only one guide track or groove will be provided in one member or the other and the movement of the secondary member will be controlled by two spigots of the same member following the same guide track or groove of the other member.

In one embodiment of the invention, the primary member includes a ring and one or more guide plates which interfit together with the ring, to form the primary member, the center portions of the guide plate(s) being removed to receive the ring therewithin.

The ring preferably has one or more pin-like projections on its undersurface which is, or are, adapted to pierce a base board on which the primary member seats so as to hold said ring in position. The ring is preferably provided with one or more bosses on its external periphery, which, in use, is or are, adapted to engage in serrations or teeth on the inner periphery of the guide plate(s) so that the guide plate(s) may be indexed relative to the ring. The top surface of the ring is provided with grooves which form a guide track to receive a spigot attached to the undersurface of the secondary member.

In another embodiment of the invention, two guide plates are provided, the thickness of the two plates together being equal or substantially equal to the depth of the ring, so such that the upper edge of the ring and the upper surface of the top plate lie in substantially the same plane.

Each guide plate is formed with at least one planar surface, and preferably, each planar surface is provided with one or more guide tracks or grooves. The cross-sectional shape of such grooves being such that it is capable of receiving and guiding the tip of a stylus with a minimum of friction and with maximum accuracy.

The secondary member or cursor preferably includes a fixed spigot located on its undersurface, which is adapted to be located in the groove in the ring, when the secondary member is placed in operative position on top of the primary member. In one embodiment, the cursor is provided with a series of apertures and notched slots through which a stylus may project to engage with the track(s) or groove(s) in the guide plate. The cursor is also provided with a plurality of holders for holding a pen or similar instrument, each having a hole through which the point of the pen may project to contact a surface upon which a design or pattern is to be produced; the cursor being tiltable so as to raise the pen points clear of said surface.

The invention will best be understood by reference to the following drawings wherein:

FIG. 2 is a partial top plan view of the disc-shaped guide plate of FIG. 1 in greater detail, and to a larger scale;

FIG. 3 is a sectional view taken along line III—III of FIG. 2;

FIG. 4 is a partial top plan view of the reverse side of the disc-shaped guide plate of FIGS. 1 and 2;

FIG. 5 is a sectional view taken along line V—V of FIG. 4;

Figure 1:
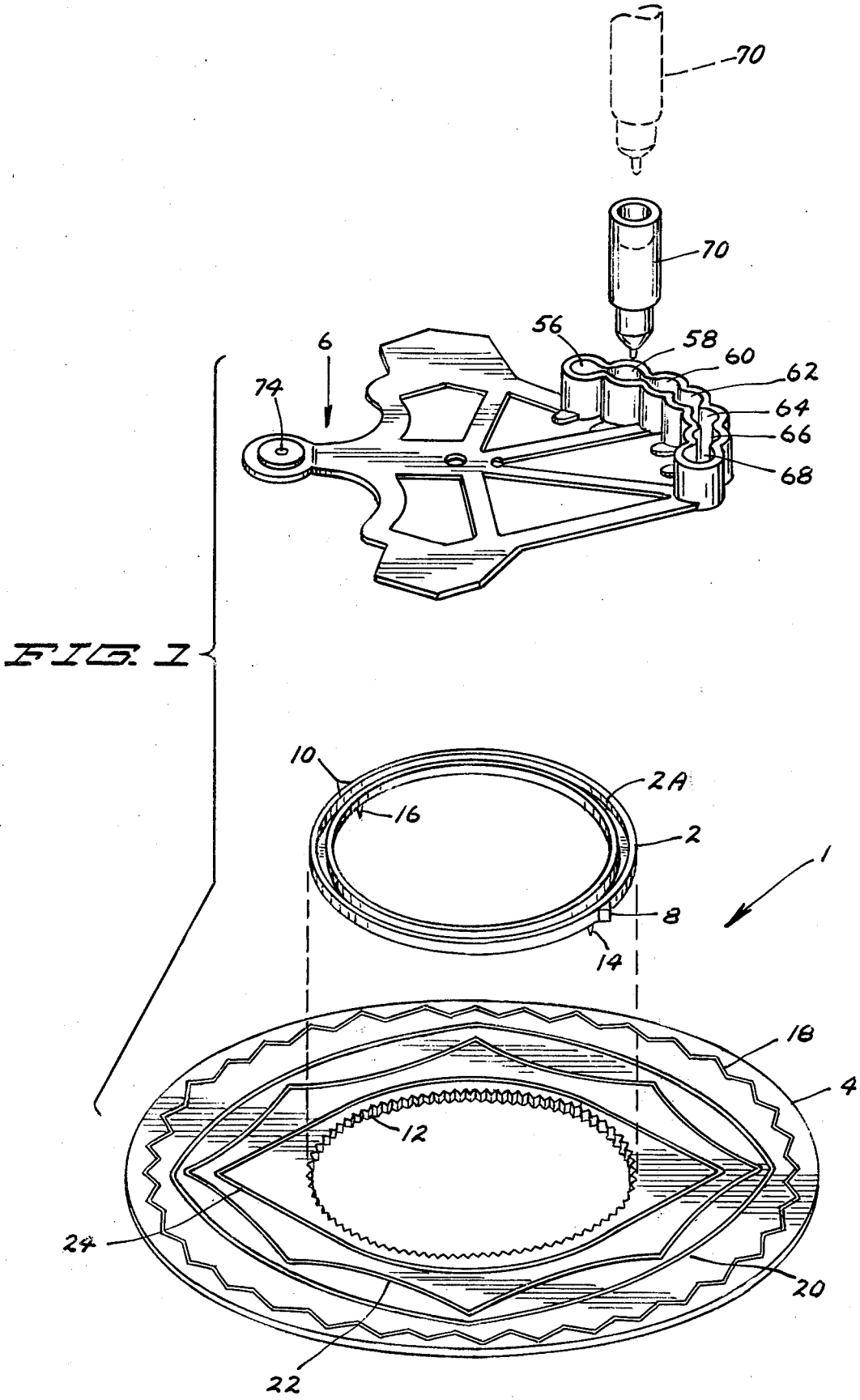
FIG. 1 is an exploded, perspective view of a drawing instrument according to the invention.

Specific reference is now made to FIG. 1, which illustrates a drawing instrument, which includes a primary member formed of a ring 2 and a guide plate 4, and a secondary member or cursor 6.

The ring 2 of the primary member has a groove or channel 2A in its upper surface which is adapted to receive a fixed stylus 54 (FIG. 7) mounted on the cursor 6. The ring 2 is provided with diametrically opposed bosses or projections 8 and 10, which when the ring 2 lies within the guide plate, engage in serrations or teeth 12 on the inner periphery of the guide plate 4. Thus, by disengaging the serrations or teeth 12 from the bosses or projections 8 and 10, rotating guide plate, and re-engaging the serrations or teeth with the bosses or projections, the guide plate 4 may be indexed relative to the ring 2.

On the undersurface of the ring 2 there is provided, in proximity to the bosses or projections 8 and 10, pin-like projections 14 and 16 which are adapted to pierce a base board or the like (not shown) when the instrument or apparatus is in use; this prevents relative movement between the primary member and base board.

As can be seen from the drawing, the guide plate 4 has four endless tracks or grooves 18, 20, 22 and 24 formed therein. Each of the grooves has a different configuration and the several parts of each track are symmetrically arranged about the theoretical center point of the guide plate. The opposite side of the guide plate — see FIG. 4 — is provided with a further series of endless grooves or tracks 26, 28, 30, and 32 which are of different configurations relative to the grooves or tracks 18, 20, 22, and 24. As can be seen, each guide plate is numerically marked adjacent its periphery, and these numbers may be used for indexing the plate, or to guide a user of the apparatus when a pattern or design is being produced.

Reference is now made to FIGS. 2 and 4. It can be seen that between the guide tracks or grooves 18 and 30, 20 and 22, 22 and 24, and between the guide track or groove 24 and the inner periphery of the plate, and similarly between the guide grooves or tracks 26 and 28, 28 and 30, 30 and 32, and between the groove or track 32 and the inner periphery of the plate, there is provided what might be termed panels of grooves or tracks referenced 18A, 20A, 22A, 24A, and 26A, 28A, 30A, and 32A, respectively, which like the guide grooves or tracks are adapted to be engaged by a stylus as will be later explained. The grooves or tracks in the guide plate are designed such that their cross-sectional shape will guide the stylus with a minimum of friction and a maximum of accuracy.

In one embodiment of the invention, there will be two guide plates 4, arranged about the ring 2, one on top of the other, the combined thickness of the two guide plates being equal or substantially equal to the depth of the ring 2, so that the top surface of the ring and the upper surface of the upper guide plate lie in substantially the same plane.

Figure 6:
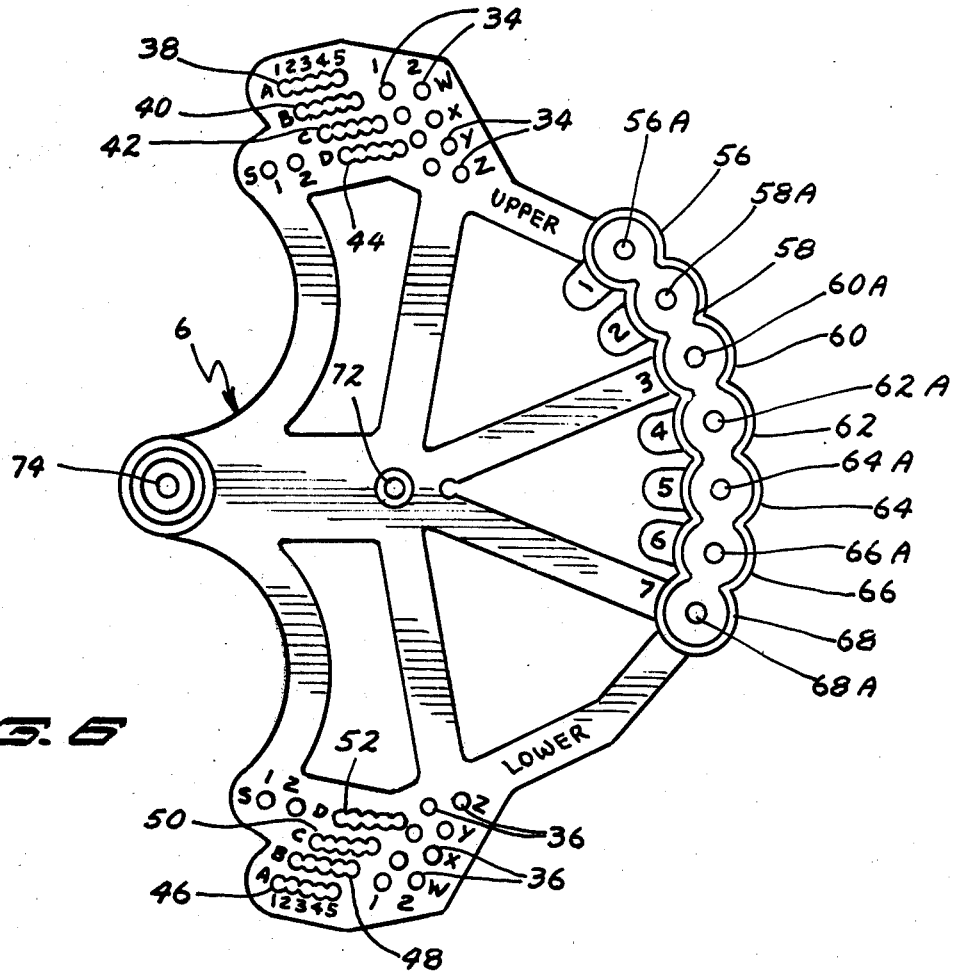
FIG. 6 is a top plan view of the secondary member or cursor illustrated in FIG. 1, to a larger scale and in greater detail.

FIGS. 1 and 6 illustrate one form of the secondary member or cursor 6. The cursor 6 includes a spigot or stylus 54 which is adapted to be positioned in the groove 2A formed in the ring 2, when the cursor 6 is in operative position relative to the primary member 1. The cursor 6 is provided with series of holes or bores 34 and 36, and notched slots 38, 40, 42 and 44, and 46, 48, 50 and 52, as depicted more fully in FIG. 6. These holes and notched slots are for receiving a hand held stylus (not shown) which when projecting through the cursor 6 is adapted to engage in the groove(s) or track(s) in the guide plate of the primary member 1.

The cursor 6 is also provided with a plurality of pen holders 56, 58, 60, 62, 64, 66 and 68, the bottoms of which are each provided with a hole or bore 56A, 58A, 60A, 62A, 64A, 66A, and 68A respectively. The point of a writing or drawing instrument, such as a pen 70 (FIG. 1), is adapted to project through the bores when such an instrument, or a plurality of instruments, are placed in the holders. As observed, the pen holders are numbered 1 through 7 on the cursor 6.

Figure 7:
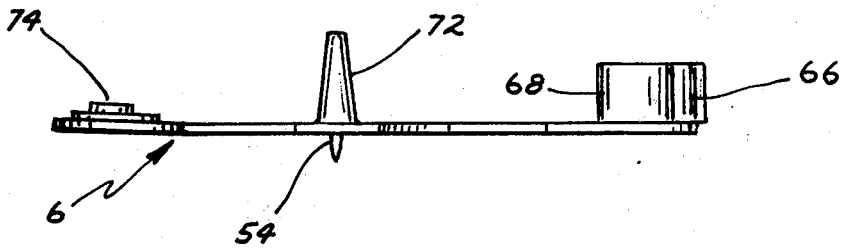
FIG. 7 is a side view of FIG. 6.

An upwardly extending projection 72 is positioned at the center portion of the cursor 6. It provides means by which the cursor 6 may be held and lifted from and placed in position relative to the primary member. As shown in FIG. 7, the end of the cursor remote from the pen holders is inclined or tapered with respect to the remainder of the cursor, and it is provided with a button 74 by which the cursor may be tilted to raise the point of pen(s) 70 clear of the primary member.

The cursor 6 is preferably formed of a transparent synthetic plastic material so that the design or pattern being produced on a surface beneath, can be readily viewed.

In use, the ring 2 is placed on a sheet of drawing paper incorporated in or on a base board (not shown) and pressed downwardly such that the pin-like projections 14 and 16 enter the base board and secure the ring thereto. A pair of guide plates 4, such as that shown in the drawings, are then placed one on top of the other and located about the ring 2, the bosses or projections 8 and 10 on the ring 2 engaging in the serrations or teeth 12 in the guide plates, thus preventing relative movement between the plates and ring. Thus, the primary member 1 is formed which is a fixed, non-movable member so far as the drawing of a pattern or design is concerned.

The cursor 6 is then placed on top of the primary member 1, so that the fixed spigot 54 engages in the groove 2A in the ring 2. One or more pens 70 are then placed in a corresponding number of the pen holders on the cursor 6, at the same time keeping the point(s) or tip(s) of the pen(s) clear of the drawing surface by applying pressure to the button 7A. A hand-held stylus (not shown) is then placed into one of the holes 34, 36 or notches 38–52, in the cursor so that it engages one of the guide tracks or grooves 18–32, or panels of grooves 18A–32A, in the upper surface of the upper guide plate 4.

By manually moving and controlling the hand-held stylus to follow a selected track or groove in the guide plate 4, the cursor can be moved relative to the primary member 1. The fixed spigot 54 is caused to follow an orbital path by virtue of the groove 2A. One or more patterns or designs will be simultaneously drawn upon the drawing surface. Movement of the hand-held stylus in the chosen track or groove will continue until the end of the track or groove is reached or until the starting point is reached. In the case of a panel of grooves such as 18A, the hand-held stylus should be moved over the whole of the panel so that a solid or semi-solid shape, is produced.

In order to produce a composite pattern, a new design can be added by selecting a different guide track, selecting a different location (hole or notched slot) for the hand-held stylus, selecting a different location for the pen or pens, indexing the guide plate to a new position, or by a combination of any or all of the above.

Figure 8:
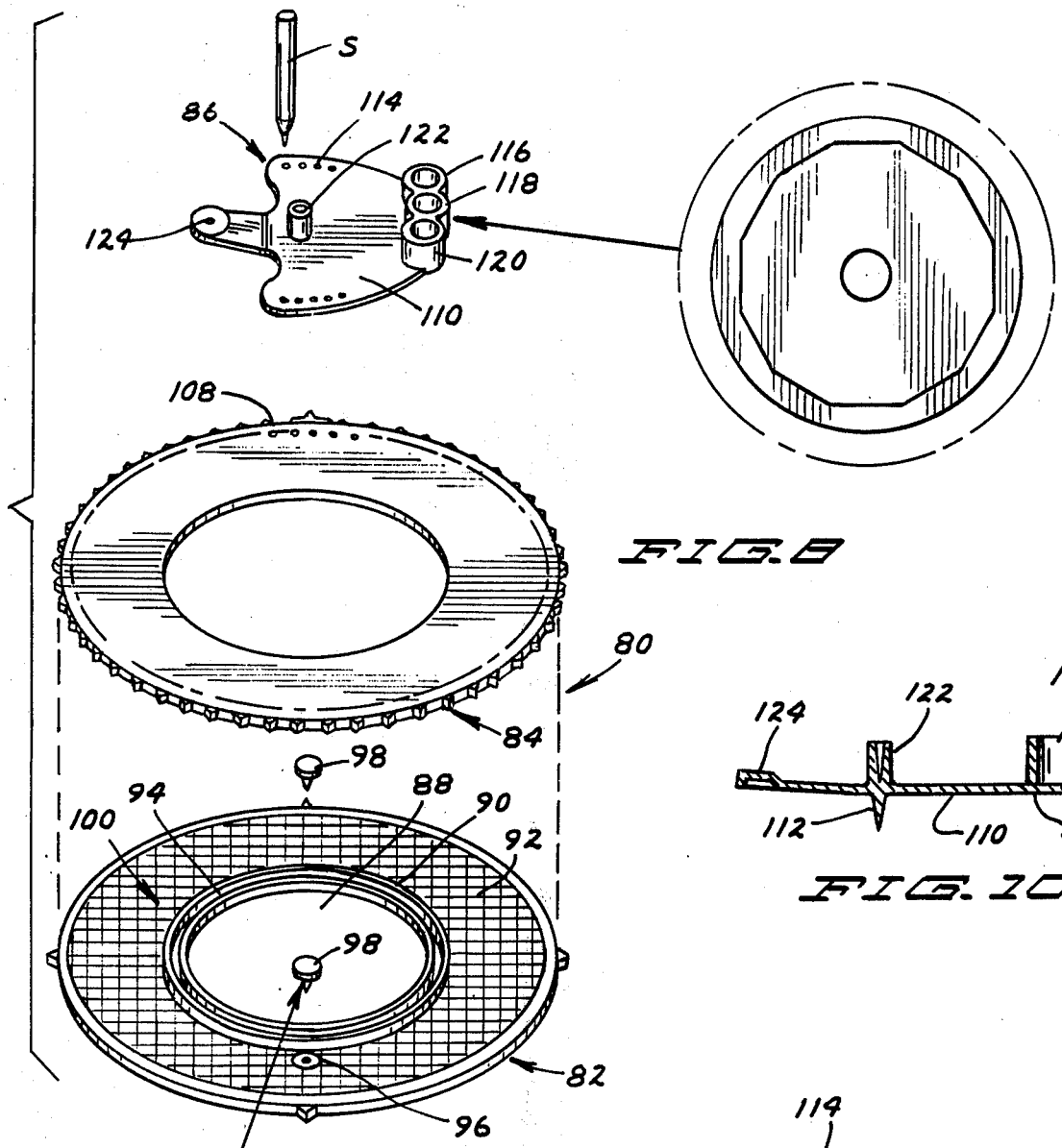
FIG. 8 is an exploded, perspective view illustrating another embodiment of the invention, with insets showing enlarged views of certain portions.
Figure 10:
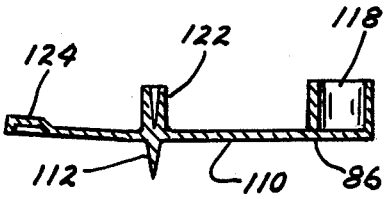
FIG. 10 is a sectional view taken along line X—X of FIG. 9.
Figure 9:
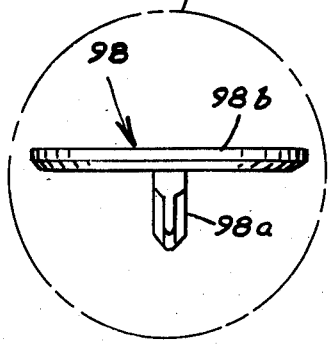
FIG. 9 is a top plan view of a modified cursor, which forms a part of the instrument depicted in FIG. 8.
Figure 9:
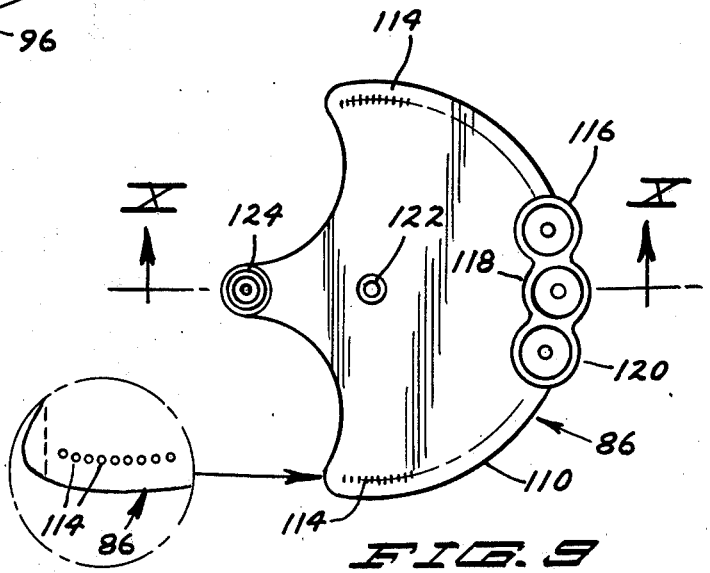
Figure 11:
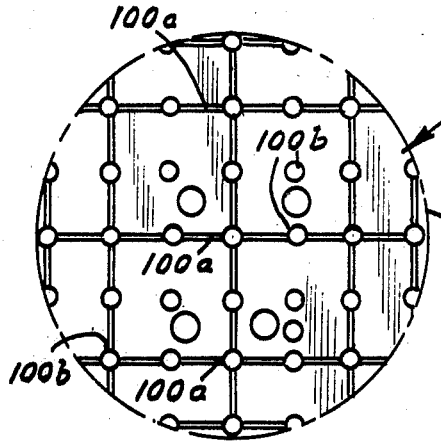
FIG. 11 is a top plan view of a base plate forming a part of the instrument shown in FIG. 8, with an inset showing a portion of the upper surface of the base plate to an enlarged scale.
Figure 11:
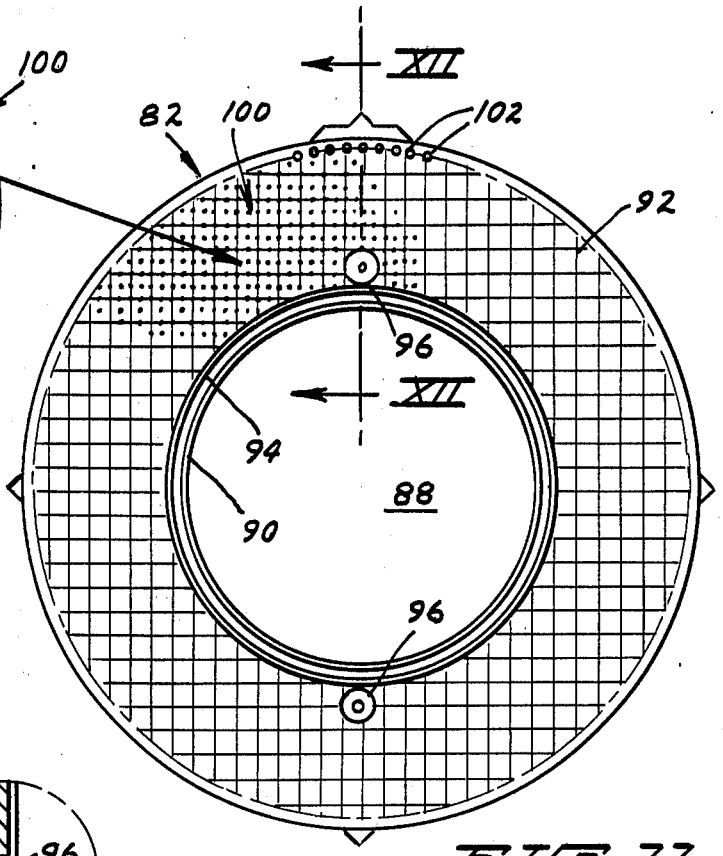
Figure 12:
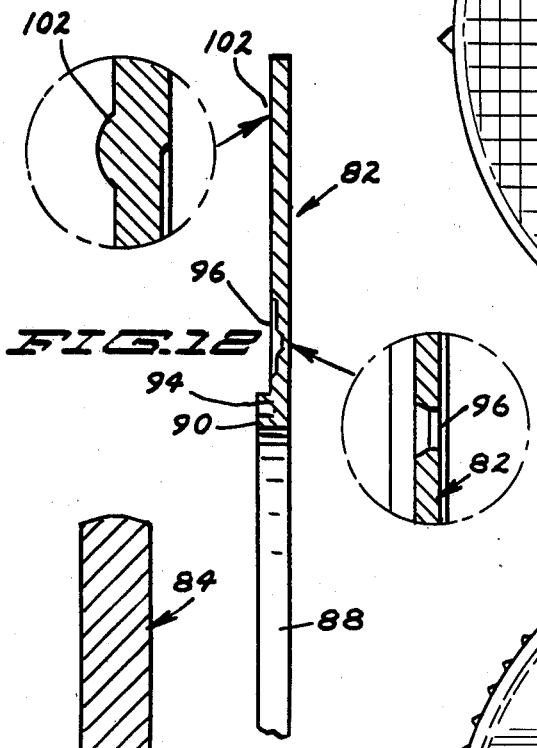
FIG. 12 is an enlarged sectional view taken along line XII—XII of FIG. 11, with insets showing portions thereof.

Reference is now made to FIGS. 8–14, which illustrate another embodiment of the invention. As illustrated in FIG. 8, the drawing instrument 80 includes a base plate 82, formed of a transparent, synthetic plastic material, a design plate 84, and a cursor 86. The base plate 82 is illustrated in greater detail in FIGS. 11 and 12. It is of annular form with a central aperture 88 surrounded by a rim 90 standing proud of the adjacent planar surface 92. The rim 90 has a circular groove 94 formed therein. At diametrically opposed locations adjacent the rim 90 are provided two countersunk holes or bores 96 for the reception of fixing pins 98, each of which has a quadriangular section, shank 98*a* and a flat head 98*b*.

The planar surface 92 is marked with a coordinate grid 100 defined by ribs 100*a* and projections 100*b*. Suitable numbering (not shown) is engraved on the base plate to complete the coordinate grid 100. A continuous ring of part-spherical protrusions 102 is provided on the planar surface 92, adjacent the outer periphery of the plate 82 for the purpose of locating the design plate 84.

Figure 14:
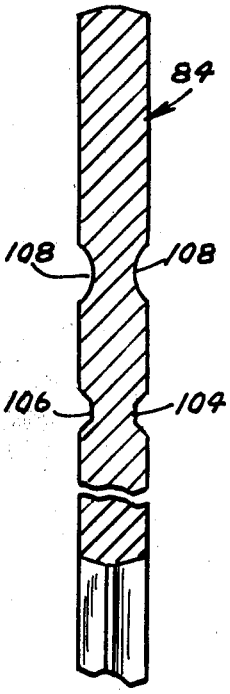
FIG. 14 is an enlarged sectional view taken along line XIV—XIV of FIG. 13.
Figure 13:
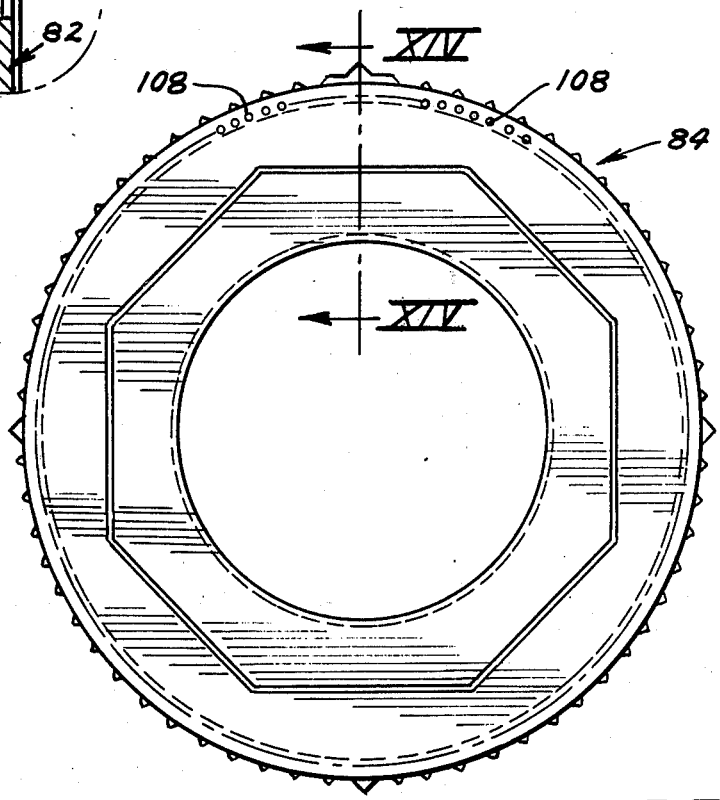
FIG. 13 is a top plan view of a design plate forming part of the instrument depicted in FIG. 8.

The design plate 84 is an annulus of opaque plastic material, and both of its planar surfaces are formed with a plurality of guide tracks, two of which are illustrated in section in FIG. 14 and referenced by numerals 104 and 106. The design plate 84 may have a combination of endless guide tracks, and panels of guide tracks, in the same way as the guide plate 4 of the embodiment described with reference to FIGS. 2, 3, and 4. A ring of part-spherical recesses 108 is provided on each planar surface of the design plate 84, for engagement with the protrusions 102 of the base plate 82. The design plate 84 is numerically marked adjacent its periphery, in a similar manner as disclosed above, and these numbers (not shown) may be used for indexing the plate, or to guide a user of the instrument, when a pattern or design is being produced.

The cursor 86 is similar in construction to cursor 6 shown in FIGS. 1, 2, and 3. As such, it includes a body 110 of generally semi-circular shape with a fixed spigot 112 which is adapted to locate in the circular groove 94, of the base plate 82. The lateral regions of the body 110 are provided with a series of holes or bores generally indicated at 114 and there is also a plurality of pen holders 116, 118 and 120, a projection 122 to facilitate manipulation of the cursor and a button 124 by which the cursor may be tilted when in use. All these features are similar to those found in the embodiment previously described and their structure and function are substantially the same.

In use, the base plate 82 is positioned on a sheet of drawing paper backed by a base board, and fixed thereto by means of pins 98. A selected design plate 84 is then fitted onto the base plate 82 and is located centrally by the rim 90 and peripherally by the complementary protrusions 102 and the bore plate 108 provided on the design plate 84. The fixed spigot 112 of the cursor 86 is then engaged in the circular groove 94 and a hand-held stylus S is inserted through one of the holes or slots 114 into a selected guide track in the design plate 84. One or more pens (not shown) are accommodated in the holders 116, 118, and 120. By then manually controlling the stylus to follow the selected guide track, in the manner previously described, the cursor 86 is moved relative to the fixed base plate 82 and design plate 84, and simultaneously one or more patterns or designs will be drawn upon the drawing surface.

In order to produce a composite pattern, a new design can be added by selecting a different guide track, by selecting a different locating hole for the hand-held stylus by selecting a different holder for the pen or pens, by indexing the design plate to a new position, by a combination of any or all of the above, or by shifting the base plate 82 on the drawing surface, to a new position which can be accurately defined by reference to the coordinate grid 100.

Figure 15:
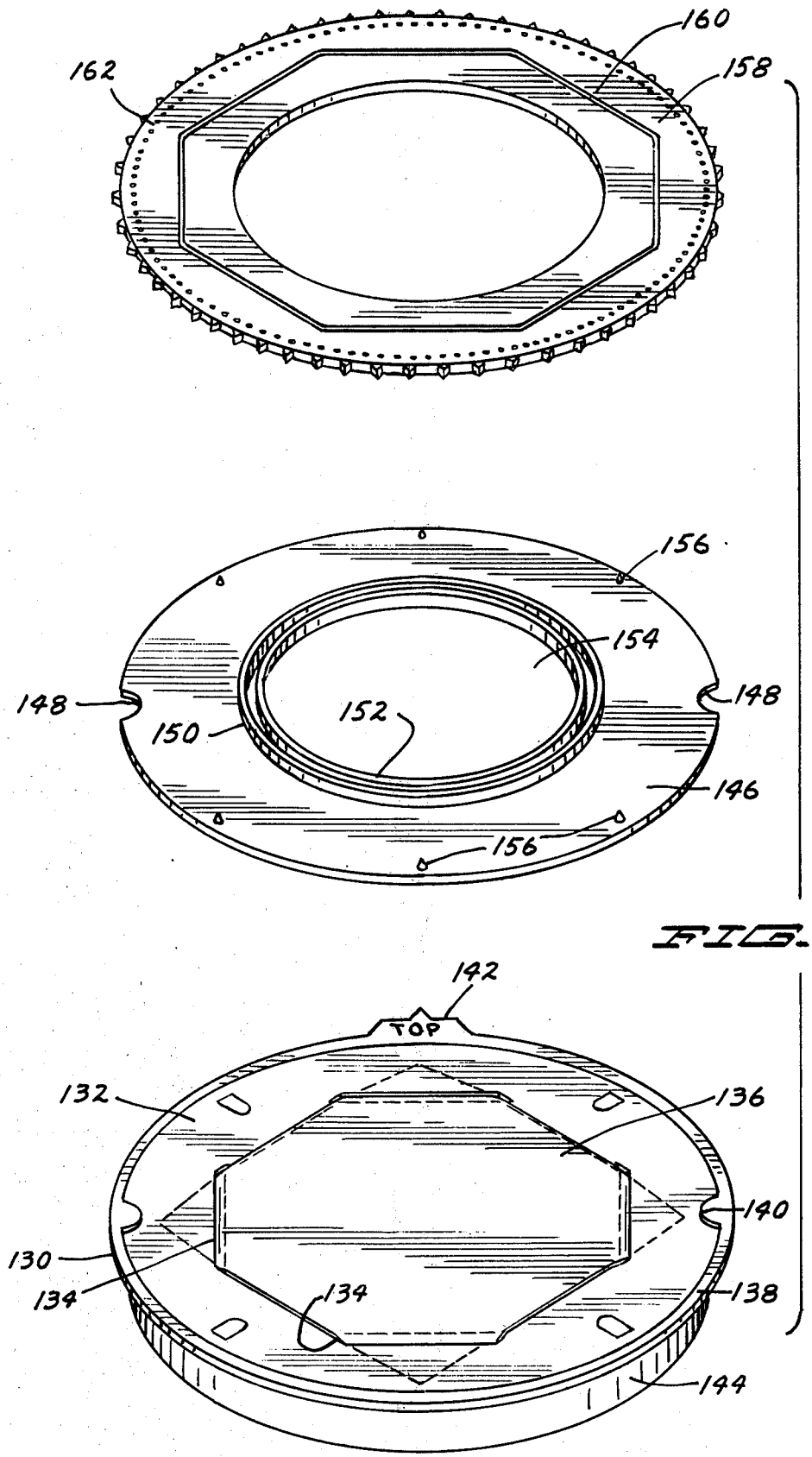
FIG. 15 is an exploded perspective view illustrating another embodiment of the invention.

In an alternate form of the invention as shown in FIG. 15, the primary member includes a frame member 130 having a top surface 132 with a plurality of slots 134 therein to receive the corners of the sheet of paper 136. A peripheral rim 138 is formed on the top surface of the frame member 130 and it includes a pair of diametrically opposed projections 140. An indicator 142 is formed as part of the rim 138. A base 144 forms the lower portion of the frame member 130, and it can be provided with appropriate means on its underside (not shown) for minimizing relative movement of the frame member 130 with respect to a surface on which it is positioned.

An annular base plate 146, having a pair of notches or cut-away portions 148 along its periphery is positionable on the frame member 130 so that the projections 140 engage the notches 148. An upstanding rim 150, having a circular groove 152 formed therein, surrounds an annular opening 154 in the base plate 146. A plurality of small, spaced-apart protrusions 156 are formed on the base plate proximate its periphery.

A design plate 158, similar to that described hereinbefore, is formed with at least one, and more preferably, several guide tracks 160 on each of its surfaces. A ring of small recesses 162 is provided on each surface of the design plate 158 proximate the periphery of the plate. The recesses 162 and the protrusions 156 are aligned relative to each other, so that each protrusion engages a recess when the design plate 158 is placed on top of the base plate 146, thus substantially eliminating relative movement between the base and design plates. The design plate 158 can readily be indexed relative to the base plate 158 and frame member 130, as described above.

A cursor, similar to that described in conjunction with FIG. 8, is provided for movement with respect to the design plate 158, and more particularly the tracks 160.

In use, a sheet of paper is mounted on the frame member 130, by inserting its four corners in the slots 134.

Thereafter, the base plate 146 is positioned on top of the paper 136 so that the projections 140 engage the notches 148. The design plate 158 is then positioned on the base plate 146, and effectively prevented from rotational movement by virtue of the mating relationship of the protrusions 156 and the recesses 162. A cursor 86 similar to that depicted in FIG. 8, is placed on the design plate 158 so that the spigot 112 engages the groove 152 in the rim 150. By inserting the point of a hand-held stylus in one of the holes 114 and aligning it with the track 160, one or more designs can be traced onto the paper 136.

In another form of the invention, the primary member may include a frame with slots therein to receive the corners of a sheet of paper, and appropriate clips may be provided for securing the corners to the underside of the frame. With such a primary member, there is no requirement for a ring 2 (see FIG. 1), the groove for the fixed spigot of the cursor being incorporated in the guide plate which is locatable in the frame. With this embodiment, the cursor is similar to that previously described, but the guide plates will be toothed or serrated on their external peripheries, these teeth or serrations engaging with pegs forming part of the primary member so as to locate and index the guide plate relative to the frame. Alternatively, the guide tracks or grooves may be located in the frame.

In a still further embodiment, the primary member may comprise a base board, paper and attachment plate which differs from the ring 2 depicted in FIG. 1, in that it will not have a groove for the fixed spigot 54 of the cursor 6. The attachment plate will incorporate the pin-like projections for piercing the paper and base board, and on its top surface or on its outer periphery, it will be provided with indexing notches or grooves to correspond with and locate the guide plate when the latter is placed on the attachment plate. The guide plate or plates will have guide tracks or grooves (and panels) only on the upper surface, the underside being designed to index and locate on the attachment plate. The guide plate will incorporate the groove in its upper surface for receiving and guiding the fixed spigot of the secondary member.

In yet a further alternative embodiment of the invention, the primary member will consist of a base board, paper and guide plate only. In this version, the guide plate will incorporate the pin-like projections on its undersurface and may be transparent so that the indexing can be achieved by repositioning the plate in such a way that the marks made by the pin-like projections are re-aligned with the index markings visible through the transparent plate.

In a still further alternative embodiment of the invention, the cursor 6 would differ from that previously described, in that the cursor would have two fixed spigots on its underside, one to go into the recess or groove in the guide plate and the other to go into the guide track or groove or panel in the guide plate. The cursor would be moved, and the spigot in the recess or groove would be made to follow the recess or groove by the application of a separate stylus, hand-held but with its point in a blind socket or hole situated near the location of the guide track or groove spigot. The said stylus would not penetrate the cursor and would not engage in any guide track or groove or panel. Furthermore, the cursor may be weighted in such as way that when the operating stylus is lifted from its socket, the cursor will rock about the line joining the two spigots in such a way that the pen(s) will be automatically lifted clear of the drawing surface. The pen or pens may be attached to a separate plate which is movable and indexable relative to the part of the cursor that carries the two spigots. This feature would produce the same effect as that achieved when the stylus is moved to a new position as previously described.

In the above description and attached drawings, a disclosure of the principles of the invention is presented, together with specific embodiments by which the invention might be carried out.

Now therefore, I claim:

1. A design drawing instrument comprising a primary member, said primary member including a ring and at least one guide plate which interfits together with said ring, the top surface of said ring having a groove therein, said guide plate having one or more guide paths, a secondary member which is movable relative to said primary member by the engagement of two spigots with said one or more guide paths, one of said spigots being attached to the undersurface of said secondary member, said groove adapted to receive said one spigot, one of said members having one or more holes or apertures through which may project the tip or point of a writing, drawing, or scribing instrument such that a design or drawing is produced on the other of said members, when said primary and secondary members are moved relative to each other.

2. A drawing instrument according to claim 1, wherein said ring has one or more pin-like projections on its undersurface, said projections being adapted to pierce a base board on which the primary member seats so as to hold said ring in position relative to said base board.

3. A drawing instrument according to claim 1, wherein said ring is provided with at least one boss on its external periphery, said guide plate having a plurality of serrations on its inner periphery, said boss adapted to engage said serrations so that the guide plate may be indexed relative to the ring.

4. A drawing instrument according to claim 1, wherein there are two guide plates, the thickness of the two plates together being substantially equal to the depth of the ring so that the upper surface of the ring and the upper surface of the top plate lie in substantially the same plane.

5. A drawing instrument according to claim 1, wherein said guide plate is formed with at least one planar surface, said surface being provided with at least one guide track, the cross-sectional shape of such track being such that it is capable of receiving and guiding the tip of a stylus with a minimum of friction and with maximum accuracy.

6. A drawing instrument according to claim 5, wherein a guide track is provided on each planar surface of the guide plate.

7. A drawing apparatus according to claim 5, wherein the secondary member is provided with a series of apertures and notched slots through which a stylus may project to engage with the guide track in the guide plate, whereby said secondary member may be moved relative to the primary member.

8. A drawing instrument according to claim 1, wherein the secondary member is tiltable relative to the primary member.

9. A drawing instrument according to claim 1, wherein the surface to be drawn upon forms part of the primary member.

10. A drawing instrument according to claim 1, wherein the primary member comprises a frame member with slots to receive the corners of a sheet of paper.

11. A drawing instrument according to claim 10, wherein at least one guide plate is adapted to be located on the frame member, said guide plate incorporating a groove for guiding a fixed spigot on the secondary member.

12. A drawing instrument according to claim 10, wherein said frame member incorporates a groove for guiding a fixed spigot on the secondary member.

13. A drawing instrument according to claim 10, wherein said guide plate is provided with teeth on its external periphery, said teeth being engageable with pegs forming part of the primary member so as to locate and index the guide plate relative to the frame.

14. A drawing instrument according to claim 1, wherein the primary member includes a base board, paper and guide plate, the guide plate incorporating pin-like projections to secure the paper to the base board and being transparent.

15. A drawing instrument according to claim 14, wherein the secondary member has two fixed spigots, said secondary member being movable by a hand-held stylus located in a blind socket or hole in said secondary member.

16. A design drawing instrument comprising a base plate with a central aperture surrounded by a circular groove, a design plate indexably locatable upon the base plate and having on at least one planar surface thereof one or more guide tracks, and a cursor having at least one holder for a marking instrument, a fixed spigot attached to said cursor which is engageable in the curcular groove for sliding movement therealong, and means enabling the cursor to be entrained by a user such that a locus of the cursor is caused to travel along the or a selected one of said guide tracks.

17. A drawing instrument as claimed in claim 16, wherein the base plate is transparent and has a coordinate grid marked thereon to facilitate accurate positioning of the base plate upon a drawing surface.

18. A drawing instrument as claimed in claim 16, wherein fixing pins are provided for insertion in openings in the base plate.

19. A drawing instrument as claimed in claim 16, wherein the circular groove is formed in a rim surrounding the central aperture of the base plate.

20. A drawing instrument as claimed in claim 16, wherein the mating surfaces of the design and base plates are provided with cooperating male and female formations for indexably locating the design plate relative to the base plate.

21. A drawing instrument as claimed in claim 16, wherein the design plate or base plate has peripheral markings to facilitate precise location of one plate relative to the other.

22. A drawing instrument as claimed in claim 16, wherein said means enabling the cursor to be entrained comprise at least one aperture through which a hand-held stylus may be inserted into a selected one of said guide tracks.

23. A drawing instrument as claimed in claim 16, wherein a frame member is provided, said frame member having a top surface with a plurality of slots therein to receive the corners of a sheet of paper, means for positioning said base plate on the top surface of said frame member whereby relative movement between the frame member and the base plate is substantially eliminated.

24. A drawing instrument as claimed im claim 23, wherein means are provided for substantially eliminating movement between the design plate and the base plate.

* * * * *